US010940992B2

(12) United States Patent
Evans

(10) Patent No.: US 10,940,992 B2
(45) Date of Patent: Mar. 9, 2021

(54) PLANT TRANSPORTATION APPARATUS

(71) Applicant: Matthew Evans, Cedar Hill, TX (US)

(72) Inventor: Matthew Evans, Cedar Hill, TX (US)

( * ) Notice: Subject to any disclaimer, the term of this patent is extended or adjusted under 35 U.S.C. 154(b) by 170 days.

(21) Appl. No.: 16/221,481

(22) Filed: Dec. 15, 2018

(65) Prior Publication Data

US 2019/0185254 A1 Jun. 20, 2019

Related U.S. Application Data

(60) Provisional application No. 62/599,173, filed on Dec. 15, 2017.

(51) Int. Cl.

| | |
|---|---|
| ***B65D 85/50*** | (2006.01) |
| ***B65D 81/22*** | (2006.01) |
| ***A47G 7/02*** | (2006.01) |
| ***A47G 7/07*** | (2006.01) |

(52) U.S. Cl.

CPC ..... *B65D 85/505* (2013.01); *B65D 81/22* (2013.01); *A47G 7/02* (2013.01); *A47G 7/07* (2013.01)

(58) Field of Classification Search

CPC ..... B65D 85/505; B65D 81/22; A47G 7/02; A47G 7/07; A01G 5/04

See application file for complete search history.

(56) References Cited

U.S. PATENT DOCUMENTS

| | | | | |
|---|---|---|---|---|
| 5,142,820 A * | 9/1992 | Aquino | A01G 5/04 47/41.12 |
| 6,055,769 A * | 5/2000 | Ray | A01G 5/04 47/41.01 |
| 6,463,697 B2 * | 10/2002 | Weder | B65D 81/05 211/74 |
| 2016/0242579 A1 * | 8/2016 | Allan | A47G 7/02 |

* cited by examiner

*Primary Examiner* — Timothy D Collins
*Assistant Examiner* — Brittany A Lowery
(74) *Attorney, Agent, or Firm* — Richard Eldredge; Eldredge Law Firm

(57) ABSTRACT

A plant transportation apparatus enables the shipment of multiple plants such as flowers in a single container. The plants are held in place by a cap. It is contemplated that the apparatus could move small or large quantities of plants.

3 Claims, 6 Drawing Sheets

PLANT TRANSPORTATION APPARATUS

BACKGROUND

1. Field of the Invention

The present invention relates generally to transportation systems, and more specifically, to a plant transportation apparatus for keeping a plant such as a flower, hydrated while being shipped from the grower to a vendor.

2. Description of Related Art

Transportation systems are well known in the art and are effective means to move items from one place to another. For example, FIG. 1 depicts a conventional flower shipper device 101 having a vial 103 with a lid 105. During use, water 107 is placed in the vial 103 and closed with a lid 105. A flower 109 is passed through the lid 105 so that an end of stem is immersed in the water 107.

One of the problems commonly associated with device 101 is its limited use. For example, device 101 is only able to carry one flower 109 resulting in multiple devices 101 being needed to move large quantities of flowers 109.

Accordingly, although great strides have been made in the area of flower shipper device, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
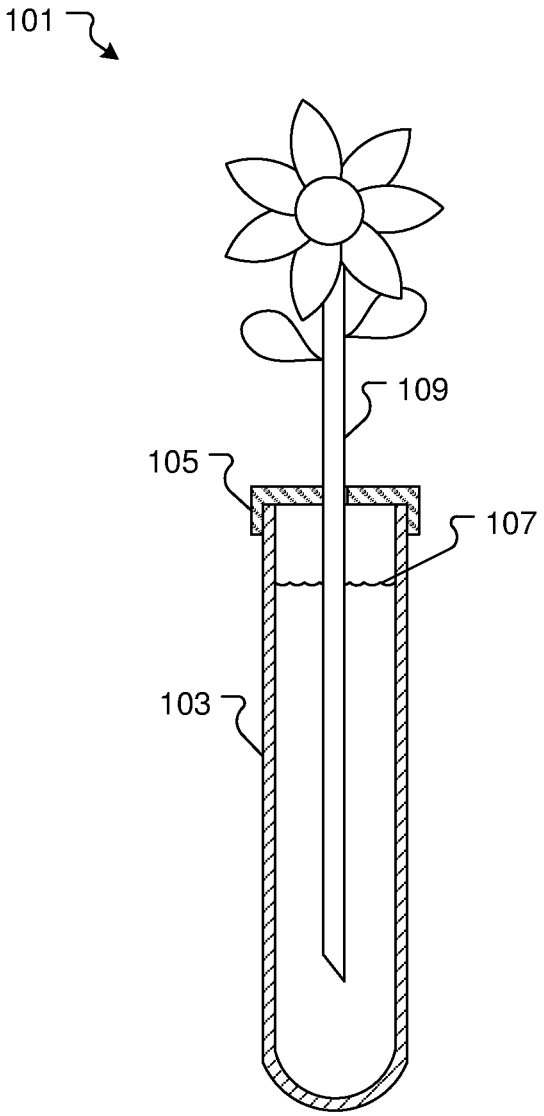
FIG. 1 (Prior Art)
FIG. 1 is a cross-sectional side view of a common flower shipper device.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional flower shipper device. Specifically, the apparatus of the present disclosure enables the rapid preparation for and transport of multiple plants. This and other unique features of the apparatus and method of use are discussed below and illustrated in the accompanying drawings.

The apparatus and method of use will be understood, both as to its structure and operation, from the accompanying drawings, taken in conjunction with the accompanying description. Several embodiments of the apparatus are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
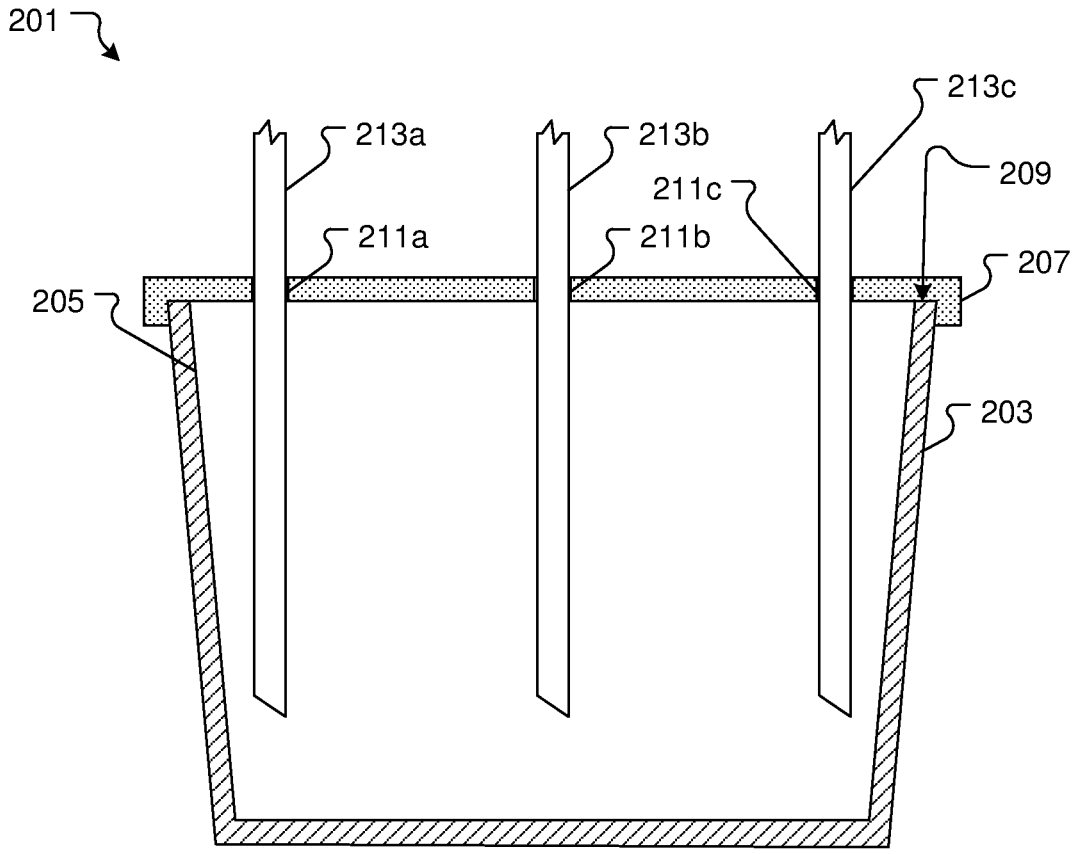
FIG. 2 is a cross-sectional side view of a plant transportation apparatus in accordance with a preferred embodiment of the present application.

Referring now to the drawings wherein like reference characters identify corresponding or similar elements throughout the several views, FIG. 2 depicts a cross-sectional side view of a plant transportation apparatus in accordance with a preferred embodiment of the present application. It will be appreciated that system 201 overcomes one of more of the above-listed problems commonly associated with conventional flower shipper devices.

In the contemplated embodiment, apparatus 201 includes a body 203 that encloses a reservoir 205 and a cap 207 that seals the top 209 of reservoir 205. The cap having a plurality of holes 211 that pass through. The cap configured to seal around what is placed in the holes 211. Plant stems 213 are passed though the holes 211.

Figure 3A:
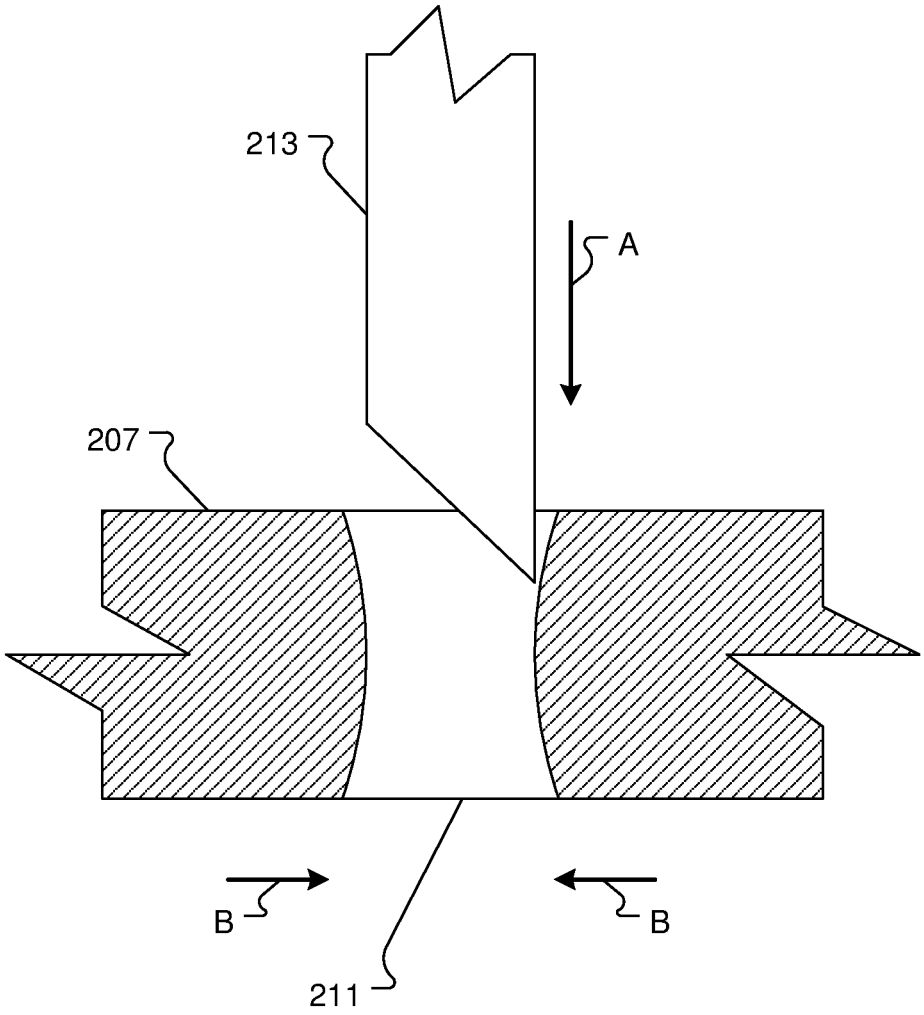
FIGS. 3A and 3B a cross-sectional side view of a hole of the cap of FIG. 2 in use.
Figure 3B:
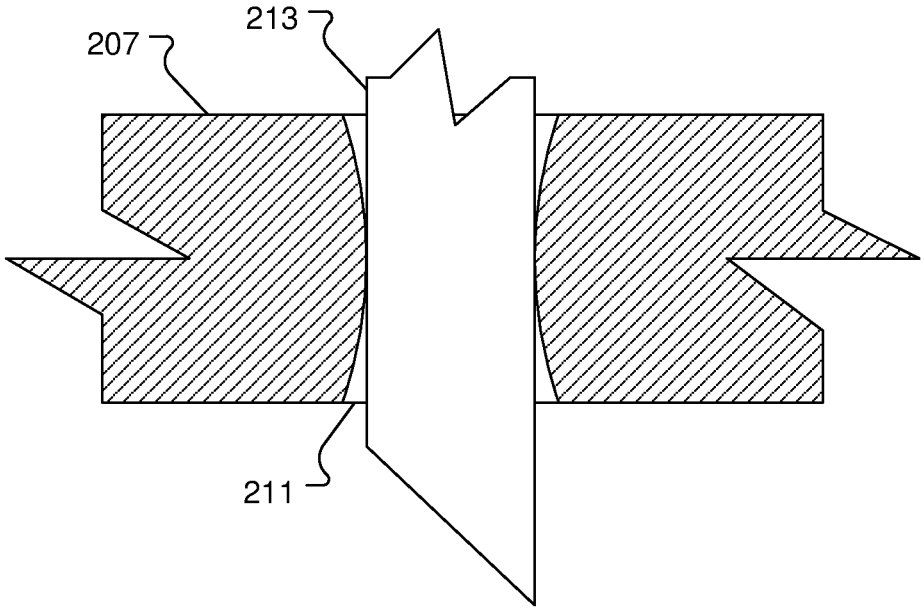

Referring now to FIGS. 3A and 3B are detail views of one of the holes 211 of cap 207 in use. The hole 211 having convex sides 301, 303 to facilitate sealing around stem 213. A stem 213 of a plant causes the hole 211 to expand as it enters as depicted by motion A. The cap 207 material seals around the stem 213 as depicted in FIG. 3B.

In use, water or a solution favorable to plants in placed in the reservoir 205. The cap is placed on the top of the reservoir 205. Plant stems 213 are passed through the holes 211 of the cap 207. The plants are transported in the apparatus 201.

It should be appreciated that one of the unique features believed characteristic of the present application is that cap 207 is configured to hold multiple plants during transport. It will be appreciated that reservoir 205 is prepared in a short amount of time and that the plants are quickly inserted though the holes 211 of the cap 207.

Figure 4:
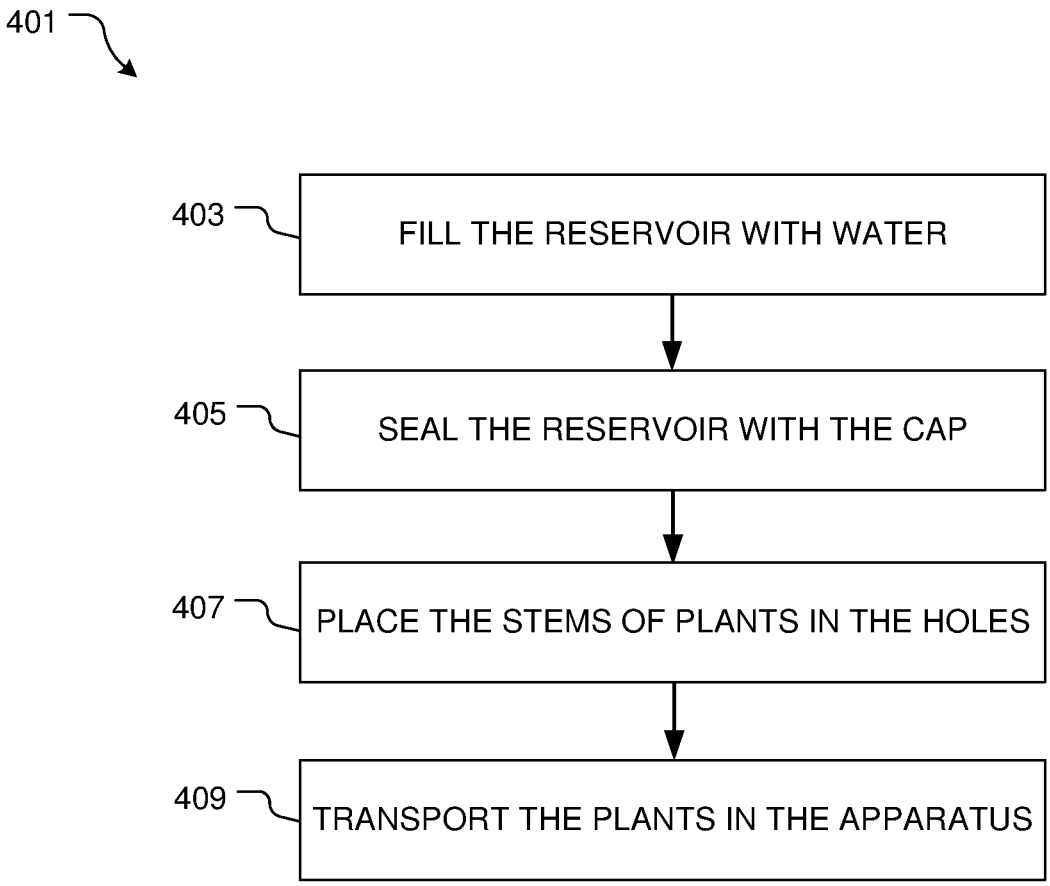
FIG. 4 is a flowchart of the preferred method of use of the apparatus of FIG. 2.

Referring now to FIG. 4 the preferred method of use of the apparatus is depicted. Method 401 filling the reservoir of the body with water or a like solution 403, sealing the reservoir with the cap 405, placing the stems of plants to be transported in the holes of the cap 407; and transporting the plants in the apparatus 409.

Figure 5:
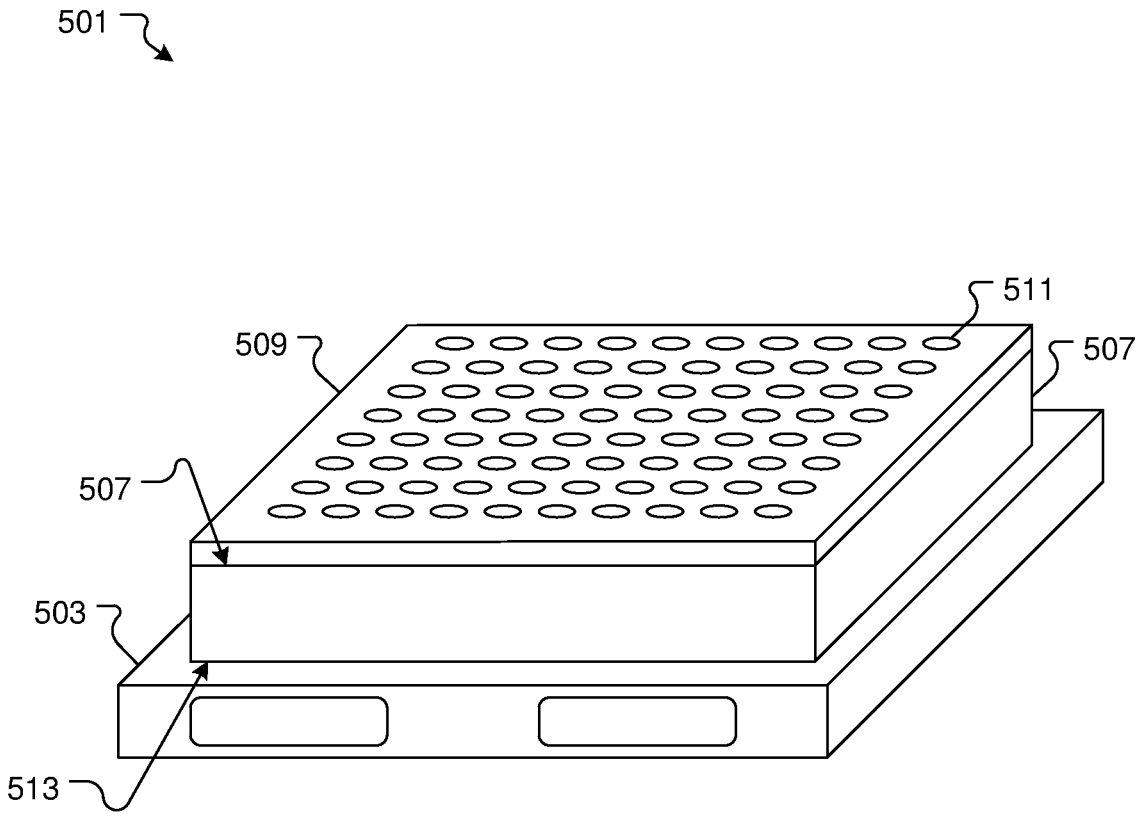
FIG. 5 is perspective view of an alternative embodiment of the apparatus of FIG. 2.

Referring now to FIG. 5 an alternative embodiment of the apparatus 201 is depicted. Embodiment 501 including a lifting structure 503 attached to the bottom 513 of a body 505. The body 505 having a reservoir open on the top 507. The reservoir being closed by a cap 509 with holes 511 passing there through. It will be appreciated that the lifting structure 503 enables the embodiment 501 to be moved by hand or mechanical means. It will also be appreciated that any number of multiple plants are contemplated to be transported by the apparatus 201, 501 and not limited to those embodiments depicted.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A plant transportation apparatus comprising:

a body having a reservoir therein;

the reservoir being closed at the top by a cap; and the cap having a plurality of holes passing there through, each of the plurality of holes having an inner surface that form a convex side creating a fluid seal between a plant stem and the reservoir;

wherein the plant stem is placed in the hole to contact a fluid in the reservoir.

2. The apparatus of claim 1 comprising a lifting structure attached to the bottom of the body, wherein the lifting structure enables the manipulation of the apparatus.

3. A method of transporting plants given the apparatus of claim 1, comprising:

providing the apparatus of claim 1;

filling the reservoir of the body with water or a like solution;

sealing the reservoir with the cap;

placing the stems of plants to be transported in the holes of the cap; and transporting the plants in the apparatus.

* * * * *